US007798136B2

(12) United States Patent
Idogawa et al.

(10) Patent No.: US 7,798,136 B2
(45) Date of Patent: Sep. 21, 2010

(54) IGNITION COIL FOR AN INTERNAL COMBUSTION ENGINE

(75) Inventors: Takashi Idogawa, Tokyo (JP); Takeshi Shimizu, Tokyo (JP); Shigemi Murata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 592 days.

(21) Appl. No.: 11/705,755

(22) Filed: Feb. 14, 2007

(65) Prior Publication Data

US 2008/0105242 A1 May 8, 2008

(30) Foreign Application Priority Data

Nov. 8, 2006 (JP) ..... 2006-302910

(51) Int. Cl.
*F02P 1/00* (2006.01)

(52) U.S. Cl. ..... 123/647; 123/634

(58) Field of Classification Search ..... 123/634, 123/635, 647

See application file for complete search history.

(56) References Cited

U.S. PATENT DOCUMENTS 4,238,165 A * 12/1980 Wagner ..... 403/408.1
4,655,658 A * 4/1987 Gulistan ..... 411/353
5,351,670 A * 10/1994 Buma et al. ..... 123/635
5,599,131 A * 2/1997 Julen et al. ..... 403/312
7,038,339 B2 * 5/2006 Gandrud ..... 310/85
7,234,454 B2 * 6/2007 Tauchi et al. ..... 123/634

FOREIGN PATENT DOCUMENTS

JP 61-277873 U 12/1986
JP 02-140824 U 11/1990
JP 2005-115383 A 4/2005
JP 2006-134972 A 5/2006
JP 2006-173384 A 6/2006

* cited by examiner

*Primary Examiner*—John T Kwon
(74) *Attorney, Agent, or Firm*—Sughrue Mion, PLLC

(57) ABSTRACT

An ignition coil for an internal combustion engine can increase a contact area between an end of a GND line terminal and a bolt thereby to reduce the contact resistance therebetween. In the ignition coil, a GND potential is ensured by the GND line terminal that is electrically connected at one end thereof to an igniter and at the other end thereof to the internal combustion engine through a bolt inserted into a bolt insertion hole formed in a mounting flange. The GND line terminal is formed at the other end thereof with a bearing surface portion having a hole into which the bolt is inserted. At least part of an inner diameter of the hole in the bearing surface portion is smaller than an inner diameter of the bolt insertion hole.

4 Claims, 10 Drawing Sheets

IGNITION COIL FOR AN INTERNAL COMBUSTION ENGINE

BACKGROUND OF THE INVENTION

1. Field of the Invention

The present invention relates to an ignition coil for an internal combustion engine in which a ground (GND) potential is ensured by a ground (GND) line terminal that is electrically connected at one end thereof to an igniter and at the other end thereof to the internal combustion engine through a bolt inserted into a bolt insertion hole formed in a mounting flange.

2. Description of the Related Art

In the past, ignition coils for an internal combustion engine that supply a high voltage to spark plugs thereby to generate spark discharges become sources of noise, and hence it is necessary to ground the internal combustion engine to reduce such noise.

As such a grounding means, there is known one using a GND line terminal that has one end thereof connected to an igniter, and the other end thereof electrically connected to an internal combustion engine through a bolt (see, for example, a first patent document: Japanese patent application laid-open No. 2006-134972).

In addition, there has also been known another one in which an electrical connection between one end of a flat GND line terminal and an internal combustion engine through a bolt is made in such a manner that the one end of the flat GND line terminal is clamped between a mounting flange and a head of the bolt and is connected therewith by tightening the bolt.

In the case of an ignition coil for an internal combustion engine using such a connection, the GND line terminal is formed integral with a case that receives a transformer by means of insert molding, but there remain insulating attachments such as oil, molding residue, etc., on the GND line terminal in this molding process, so the contact resistance between one end of the GND line terminal and the head of the bolt becomes large due to such insulating attachments.

Thus, there is the following problem. That is, while the ignition coil for an internal combustion engine has such a large contact resistance, the inner diameter of a hole at the end of the GND line terminal is equal to or larger than the inner diameter of a bolt insertion hole in a mounting flange, so the contact area between the end of the GND line terminal and the head of the bolt is small and hence the contact resistance therebetween becomes even larger.

SUMMARY OF THE INVENTION

In view of the above, the present invention is intended to obviate the problem as referred to above, and has for its object to obtain an ignition coil for an internal combustion engine which is capable of increasing a contact area between an end of a GND line terminal and a bolt thereby to reduce the contact resistance thereof.

Bearing the above object in mind, according to the present invention, there is provided an ignition coil for an internal combustion engine in which a GND potential is ensured by a GND line terminal that is electrically connected at one end thereof to an igniter and at the other end thereof to the internal combustion engine through a bolt inserted into a bolt insertion hole formed in a mounting flange. The GND line terminal is formed at its other end with a bearing surface portion having a hole into which the bolt is inserted, and at least part of an inner diameter of the hole in the bearing surface portion is smaller than an inner diameter of the bolt insertion hole.

According to the ignition coil for an internal combustion engine of the present invention as constructed above, it is possible to increase a contact area between the other end of the GND line terminal and the bolt thereby to reduce the contact resistance therebetween.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 1:
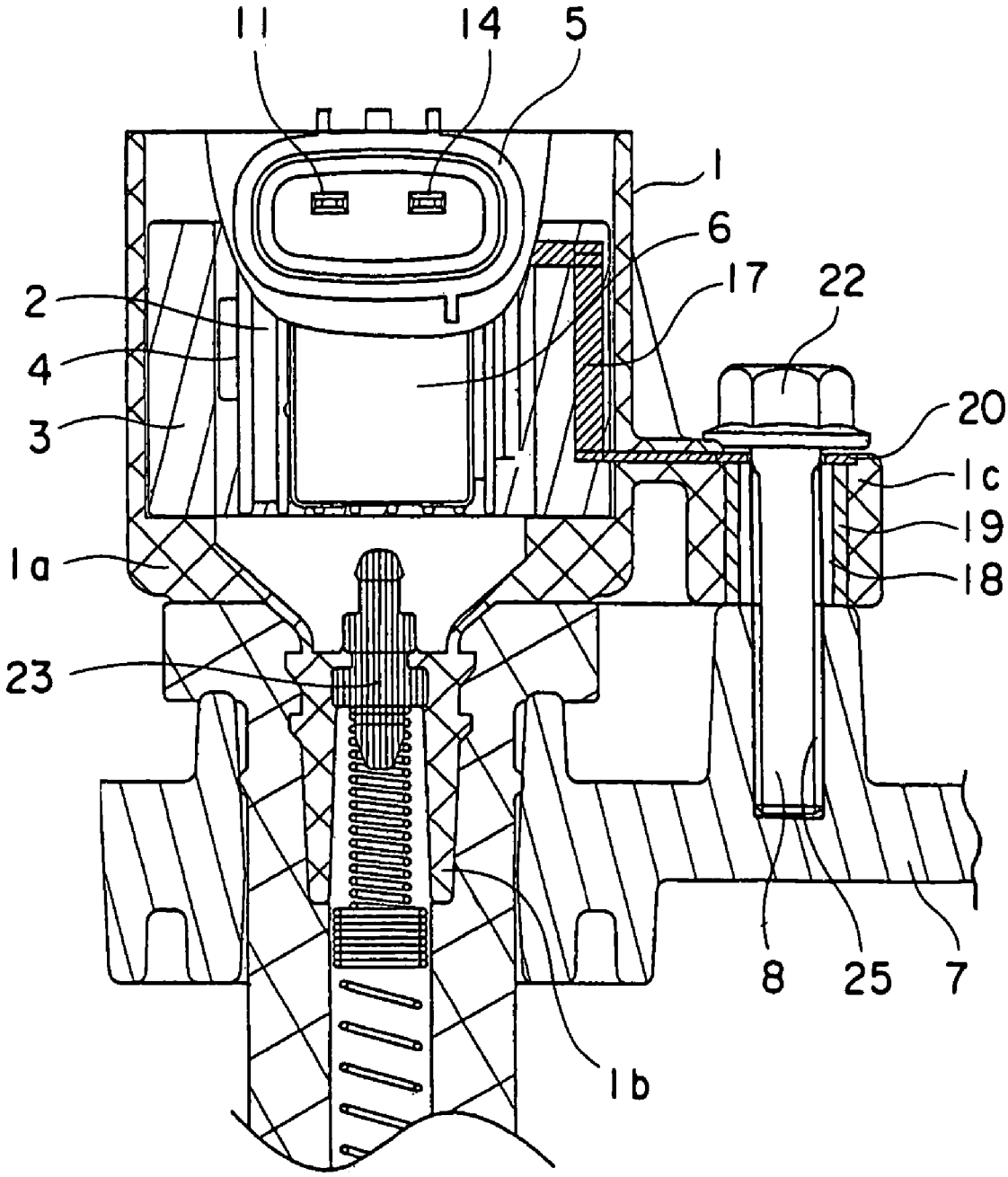
FIG. 1 is a cross sectional front view of major parts showing an ignition coil for an internal combustion engine according to a first embodiment of the present invention.

Now, preferred embodiments of the present invention will be described in detail while referring to the accompanying drawings. Throughout respective figures, the same or corresponding members or parts are identified by the same reference numerals and characters.

Embodiment 1

Figure 2:
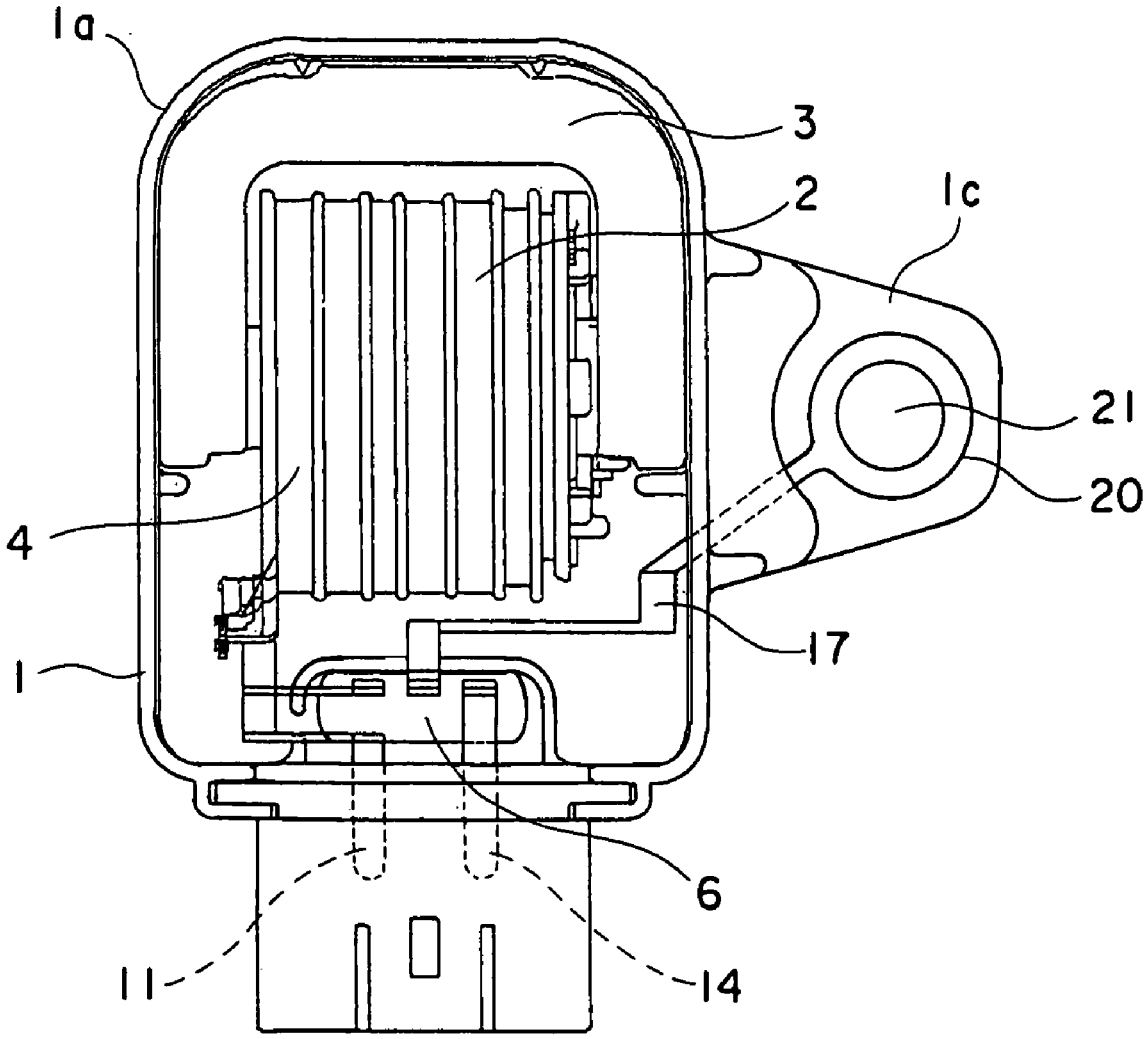
FIG. 2 is a plan view of the ignition coil for an internal combustion engine shown in FIG. 1.
Figure 3:
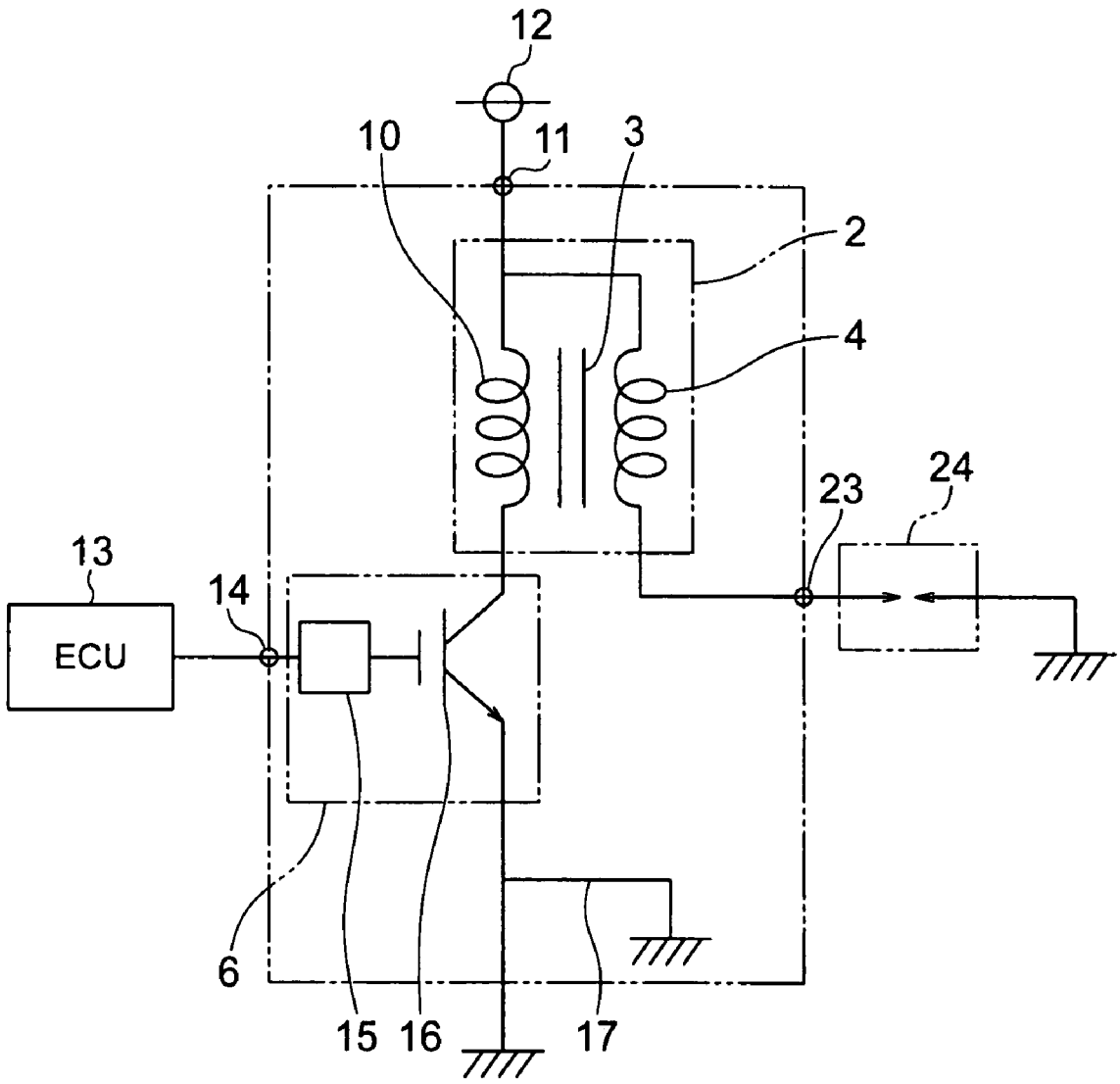
FIG. 3 is an electric circuit diagram of the ignition coil for an internal combustion engine shown in FIG. 1.

Referring to the drawings and first to FIG. 1, there is shown, in a plan view, an ignition coil for an internal combustion engine (hereinafter abbreviated as an ignition coil) according to a first embodiment of the present invention. FIG. 2 is a plan view of the ignition coil of FIG. 1, and FIG. 3 is an electric circuit diagram of the ignition coil of FIG. 1. Here, note that in FIG. 1 and FIG. 2, an insulating resin filled in a case 1 is omitted, and in FIG. 2, a bolt 8 is also omitted.

This ignition coil has a transformer 2 received in the case 1. The transformer 2 is provided with a core 3 formed of laminated thin steel plates, a primary coil 10 wound around the core 3, and a secondary coil 4 wound around the outside of the primary coil 10. The case 1 is composed of a case main body 1*a* that receives the transformer 2, a high voltage tower 1*b* that is formed integrally with the case main body 1*a* and has a plug boot made of rubber (not shown) fitted into one end thereof, and a mounting flange 1*c* that protrudes in a horizontal direction from the case main body 1*a*. The mounting flange 1*c* is formed with a bolt insertion hole 18 into which the bolt 8 is inserted.

A connector 5 is mounted on a side surface of the case main body 1*a*. In the interior of the case main body 1*a* at a side near the connector 5, there is arranged an igniter 6 which is electrically connected to the transformer 2 and the connector 5, respectively, for controlling an excitation current supplied to the primary coil 10.

The connector 5 has a battery terminal 11 connected to a battery 12 and a signal terminal 14 electrically connected to an engine control unit (ECU) 13, with the battery terminal 11 and the signal terminal 14 being integrated with each other by an insulating resin.

The igniter 6 is provided with a control IC 15 that is connected to the ECU 13 through the signal terminal 14, and a power transistor 16 that is driven by a drive signal from the control IC 15.

A belt-shaped GND line terminal 17 made of metal has one end thereof connected to the igniter 6, and the other end thereof extended up to the bolt insertion hole 18 along the surface of the mounting flange 1*c* after being lead out from the case main body la to the outside. The GND line terminal 17 is also formed at the other end thereof with a washer portion 20 having a round hole 21 in its central portion.

Figure 4:
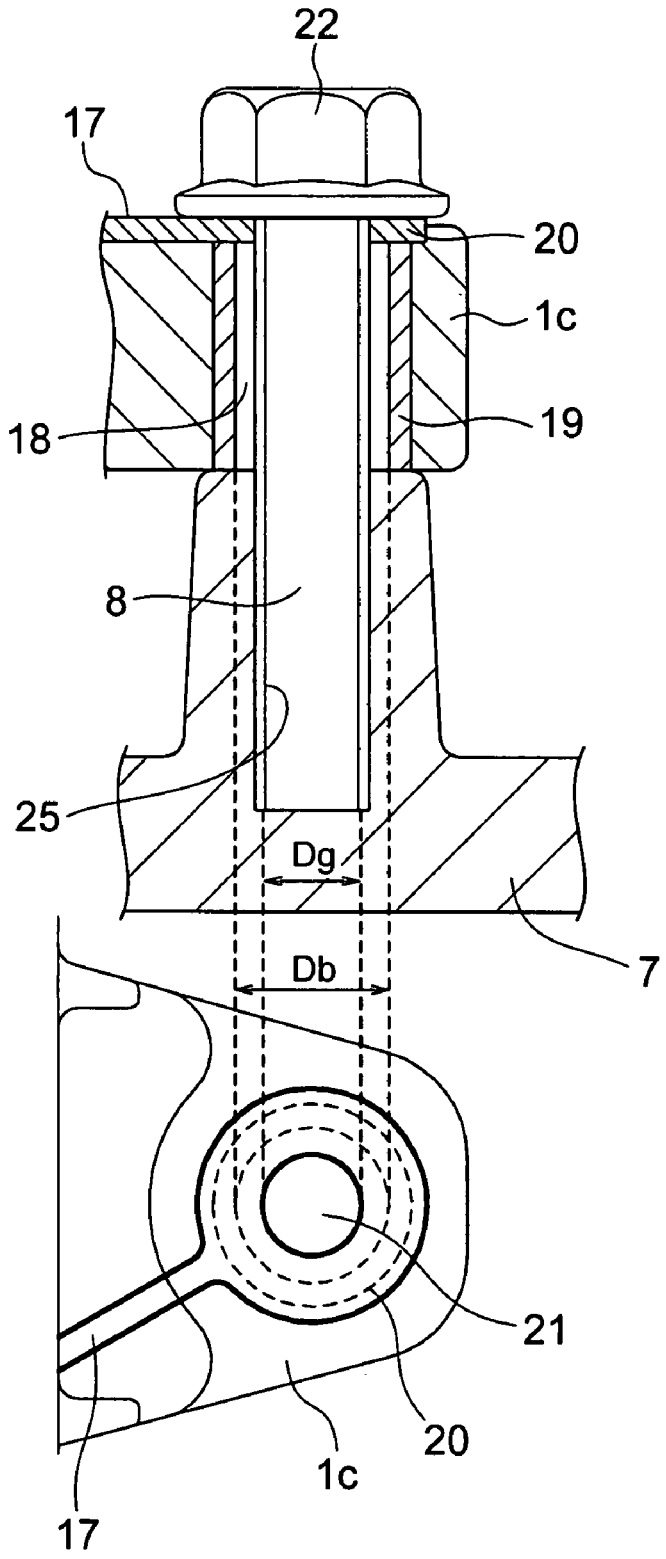
FIG. 4 is an explanatory view explaining the relation between the inner diameter of a hole in a bearing surface portion of a GND line terminal and the inner diameter of a bush fitted into a bolt insertion hole.

FIG. 4 shows the relation between the inner diameter Dg of the washer portion 20 and the inner diameter Db of a cylindrical metal bush 19 fitted into the bolt insertion hole 18 at the time when the washer portion 20 of the GND line terminal 17 has been fixedly secured to the surface of the mounting flange 1*c*. As can be seen from this figure, the inner diameter Dg of the washer portion 20 is set smaller than the inner diameter Db of the bush 19.

Next, reference will be made to the procedure of producing the ignition coil as constructed above.

First of all, the transformer 2 and the igniter 6 are electrically connected to each other. Then, a high-voltage side secondary coil terminal 23 is press-fitted into an opening portion of the high voltage tower 1*b*, whereby the transformer 2 and the igniter 6 are built into the case 1. After this, the one end of the GND line terminal 17 formed integral with the case 1 is connected with the igniter 6 by means of soldering or welding, and the connector 5, after being assembled to the case main body 1*a*, is electrically connected to the igniter 6.

Subsequently, a molten insulating resin is injected into the case 1 and set therein, so that the transformer 2 the igniter 6 are fixedly secured to the case 1 through the insulating resin while being electrically insulated from each other.

The ignition coil produced in this manner is fixedly secured to the internal combustion engine 7 by placing the washer section 20 on the flange 1*c* with the center line of the washer section 20 of the GND line terminal 17 and the center line of the bolt insertion hole 18 being made to coincide with each other, and by inserting the bolt 8 into the bolt insertion hole 18 so as to be threaded into a threaded hole 25 of the internal combustion engine 7.

In the ignition coil of the above-mentioned construction, an electric signal that is output from the ECU 13 after calculation processing therein is sent to the control IC 15 of the igniter 6 through the signal terminal 14 of the connector 5. The control IC 15 generates a drive signal for the power transistor 16, and based on this signal, the power transistor 16 controls an excitation current supplied to the primary coil 10, so that a high voltage is impressed to the high-voltage side secondary coil terminal 23, whereby a discharge is made in a gap of a spark plug 24. Here, note that upon control on the excitation current to the primary coil 10, the excitation current flows to the internal combustion engine 7 through the GND line terminal 17 and the bolt 8.

As described in the foregoing, according to the ignition coil for an internal combustion engine of this embodiment, the inner diameter Dg of the hole 21 in the washer portion 20 of the GND line terminal 17 is smaller than that of the bolt insertion hole 18, so a contact area between the rear surface of a head 22 of the bolt 8 and the washer portion 20 increases as compared with a conventional one, and the contact resistance between the bolt 8 and the washer portion 20 is accordingly reduced, thus making it possible to ensure good GND potential.

In addition, the inner diameter Dg of the hole 21 in the washer portion 20 is also made smaller than the inner diameter Db of the bush 19, so it is possible to use an inexpensive bush with an accordingly larger inner diameter tolerance.

Embodiment 2

Figure 5:
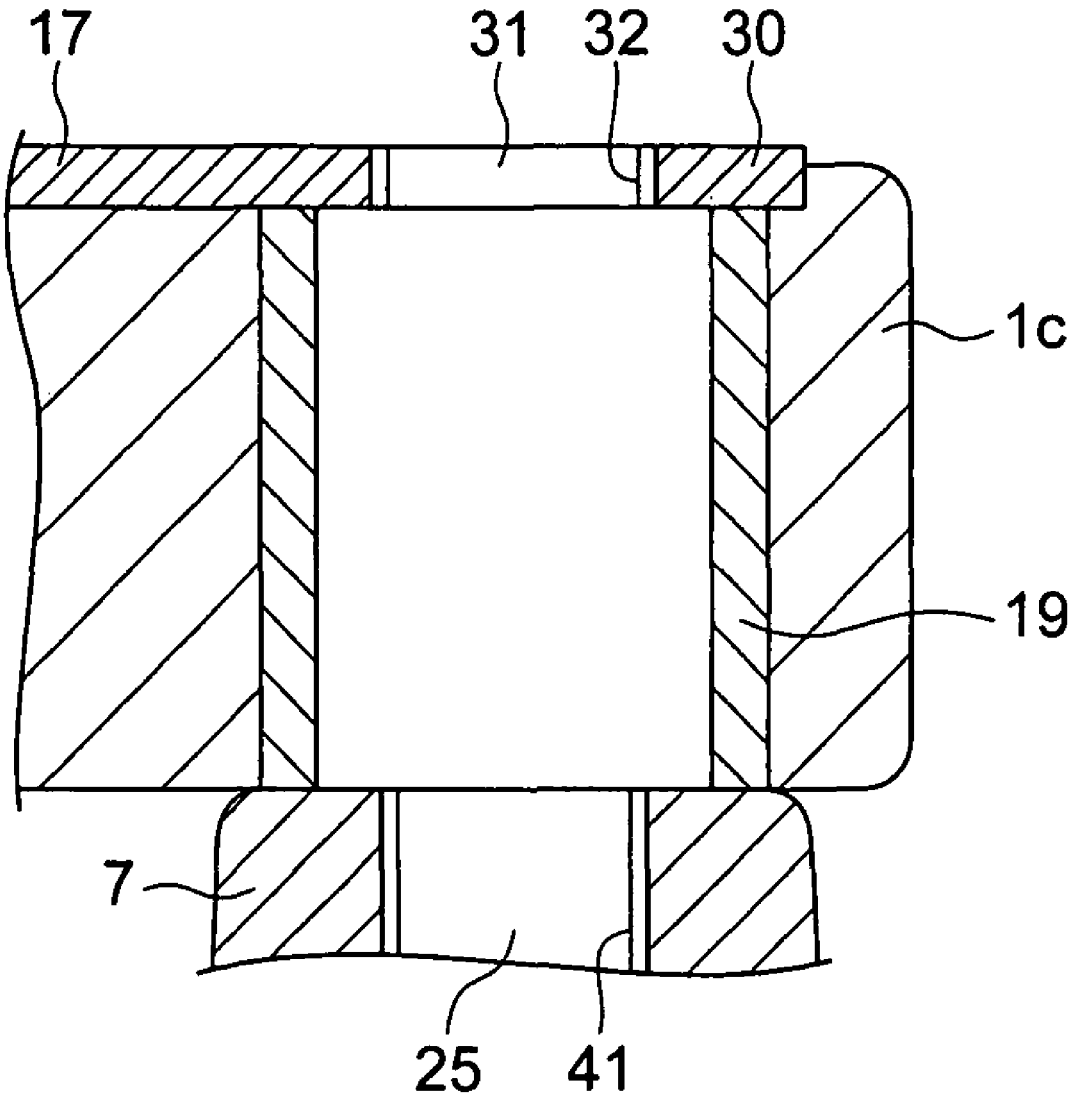
FIG. 5 is a cross sectional view of major parts showing an ignition coil for an internal combustion engine according to a second embodiment of the present invention.

FIG. 5 is a cross sectional view of major parts showing an ignition coil for an internal combustion engine according to a second embodiment of the present invention. Here, note that in FIG. 5, illustration of a bolt similar to the one (e.g., see the bolt 8 in FIG. 4) in the first embodiment is omitted. In the following description, however, the unillustrated bolt is denoted by a numeral 8 for the sake of easiness in understanding.

In this second embodiment, a thread 32 to be threaded with the bolt 8 is formed on an inner peripheral surface of a hole 31 in a washer portion 30 of a GND line terminal 17. The construction of this second embodiment other than this is similar to that of the first embodiment. Here, note that the thread 32 may be formed on a part of the inner peripheral surface of the hole 31, instead of being formed on the entire area of the inner peripheral surface of the hole 31.

In the ignition coil as constructed in the above manner, by threading the bolt 8 with the washer portion 30, the bolt 8 is smoothly inserted into the bolt insertion hole 18 in the mounting flange 1*c as* it is.

In addition, since the bolt 8 and the washer portion 30 are in threaded engagement with each other, the contact area between the bolt 8 and the washer portion 20 increases, so the contact resistance between the bolt 8 and the washer portion 20 is accordingly reduced, thereby making it possible to ensure good GND potential.

Further, by placing beforehand the bolt 8 into threaded engagement with the washer portion 30 of the GND line terminal 17 formed integral with the case 1 upon mounting of the ignition coil on the internal combustion engine 7, the bolt 8 can be handled as a single unit together with the case 1 and the GND line terminal 17, whereby the number of man-hours of work required can be reduced and the bolt 8 can be prevented from being lost.

Embodiment 3

Figure 6:
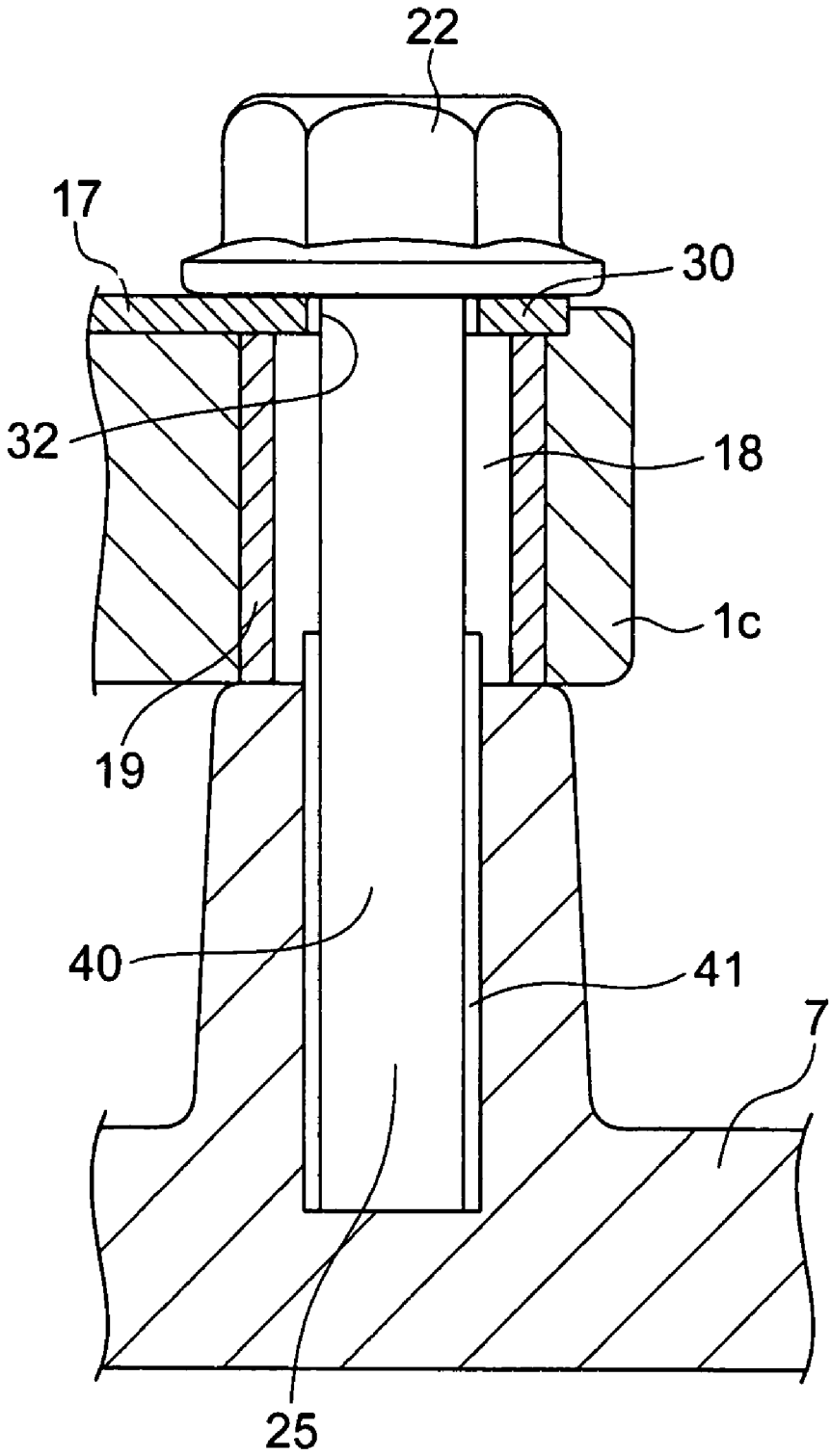
FIG. 6 is a cross sectional view of major parts showing an ignition coil for an internal combustion engine according to a third embodiment of the present invention.

FIG. 6 is a cross sectional view of major parts showing an ignition coil for an internal combustion engine according to a third embodiment of the present invention.

In this third embodiment, a bolt 40 has a thread 41 formed, only at a portion thereof opposite to a head 22, for threaded engagement with a threaded hole 25, and no thread is formed on a portion of the bolt 40 near the head 22. The construction of this third embodiment other than the above is similar to that of the second embodiment.

In the ignition coil of this third embodiment, a region in which the thread 41 of the bolt 40 is formed is smaller as compared with that of the second embodiment, so the time required for threaded insertion of the bolt 40 when the bolt 40 is inserted into the bolt insertion hole 18 through the washer portion 30 is shortened, thus making it possible to improve the operation of insertion of the bolt 40.

Embodiment 4

Figure 7:
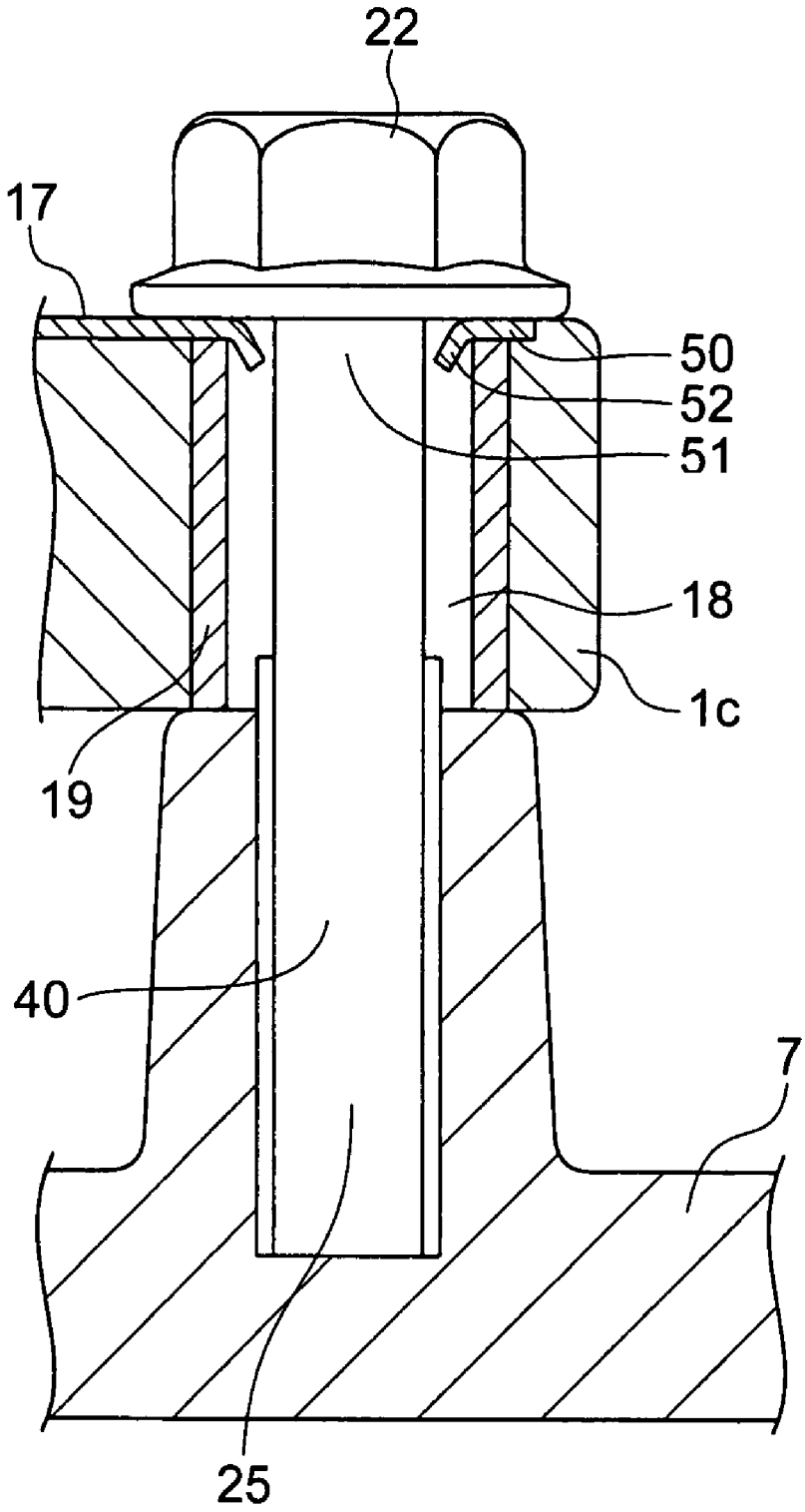
FIG. 7 is a cross sectional view of major parts showing an ignition coil for an internal combustion engine according to a fourth embodiment of the present invention.

FIG. 7 is a cross sectional view of major parts showing an ignition coil for an internal combustion engine according to a fourth embodiment of the present invention.

In this fourth embodiment, a washer portion 50 of a GND line terminal 17 has a bent portion 52 formed on an inner peripheral portion of a hole 51 so as to be bent to a side near an internal combustion engine 7. The construction of this fourth embodiment other than the above is similar to that of the third embodiment.

In the ignition coil of this fourth embodiment, when the bolt 40 is inserted into the bolt insertion hole 18, an inner peripheral edge of the hole 51 is bent to a side near the internal combustion engine 7 to form the bent portion 52. After insertion of the bolt 40, the bent portion 52 functions as a coming-off preventing member.

Accordingly, by placing beforehand the bolt 40 into threaded engagement with the washer portion 50 of the GND line terminal 17 formed integral with the case 1 upon mounting of the ignition coil on the internal combustion engine 7, the bolt 40 together with the case 1 and the GND line terminal 17 can be handled as a single unit, whereby the number of man-hours of work required can be reduced and the bolt 40 can be prevented from being lost.

Embodiment 5

Figure 8:
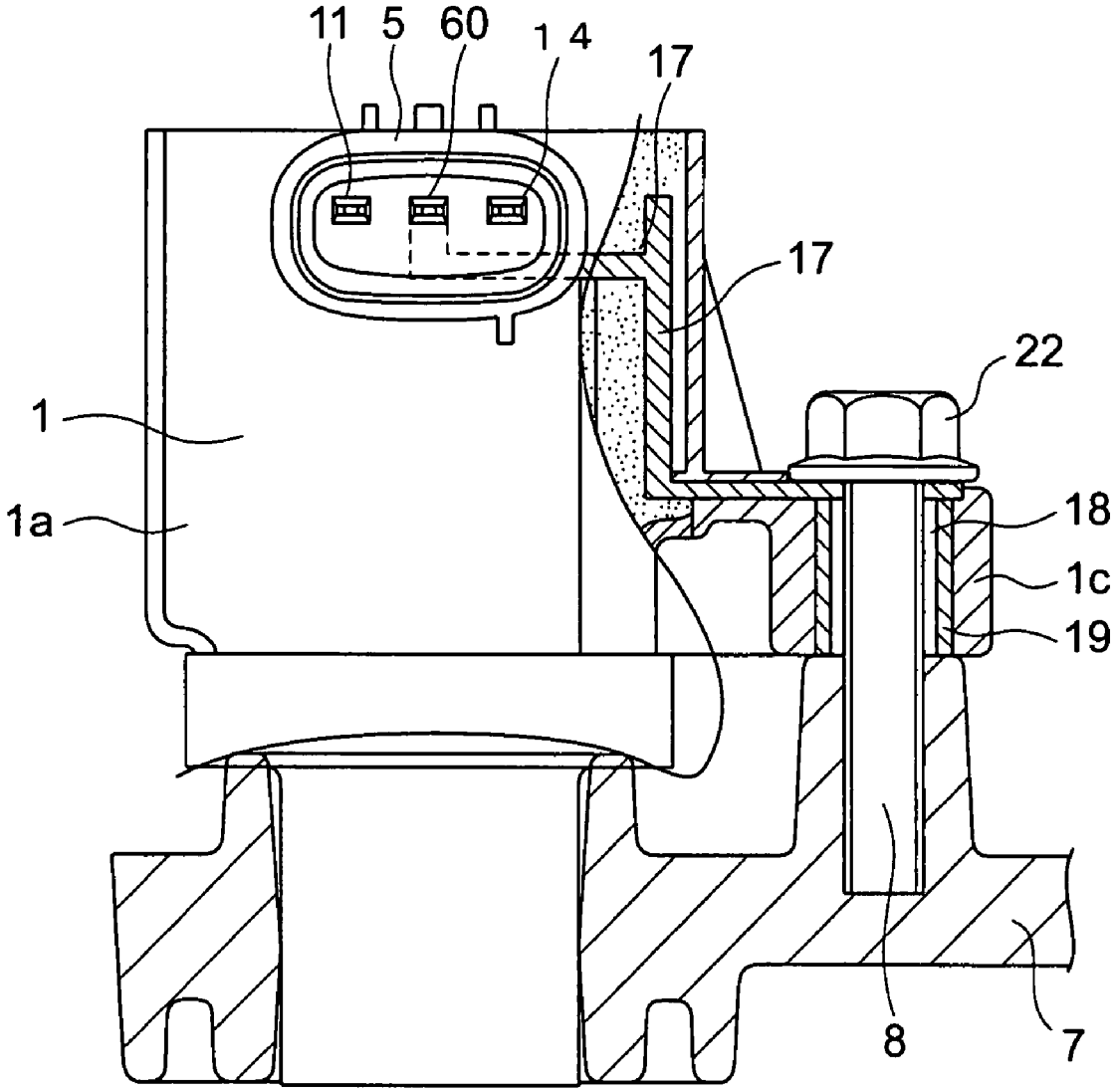
FIG. 8 is a cross sectional front view of major parts showing an ignition coil for an internal combustion engine according to a fifth embodiment of the present invention.

FIG. 8 is a cross sectional front view of major parts showing an ignition coil for an internal combustion engine according to a fifth embodiment of the present invention.

Figure 9:
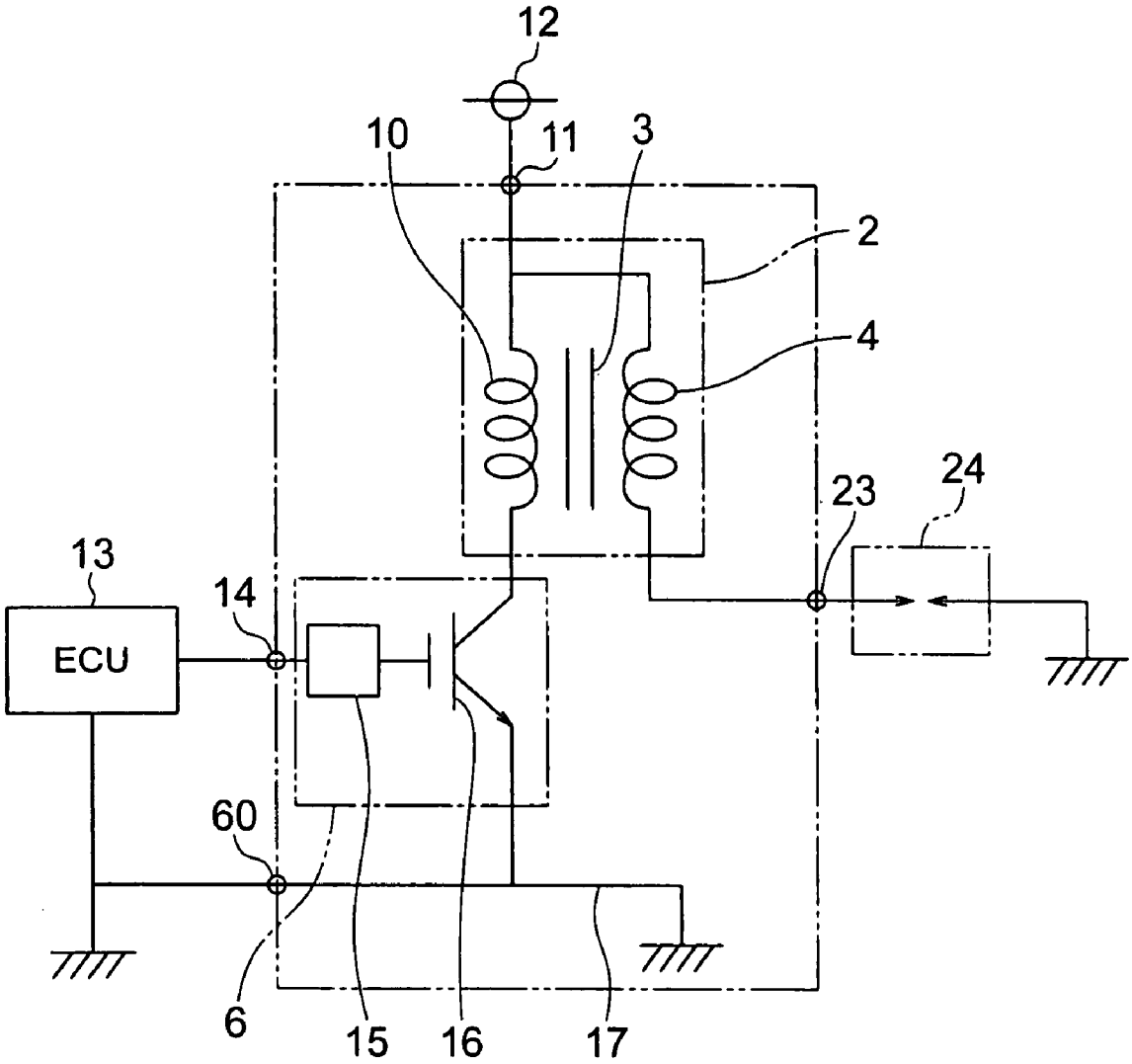
FIG. 9 is an electric circuit diagram of the ignition coil for an internal combustion engine shown in FIG. 8.

FIG. 9 is an electric circuit diagram of the ignition coil for an internal combustion engine shown in FIG. 8.

In this fifth embodiment, a connector 5 has a GND terminal 60 connected to a GND line terminal 17 and integrated with a battery terminal 11 and a signal terminal 14 by means of an insulating resin. The construction of this fifth embodiment other than this is similar to that of the first embodiment.

In the ignition coil according this fifth embodiment, by electrically connecting the GND terminal 60 to the ECU 13, it is possible to make the GND potential of the ignition coil and that of the ECU 13 in common, whereby the malfunction of the ignition coil can be prevented.

Although in the above-mentioned respective embodiments, reference has been made to an example in which the bush 19 is fitted into the bolt insertion hole 18, the present invention can also be applied to an ignition coil that is not provided with the bush 19, and can further be applied even to an ignition coil in which the GND line terminal 17 and the bush 19 are formed integral with each other.

Figure 10:
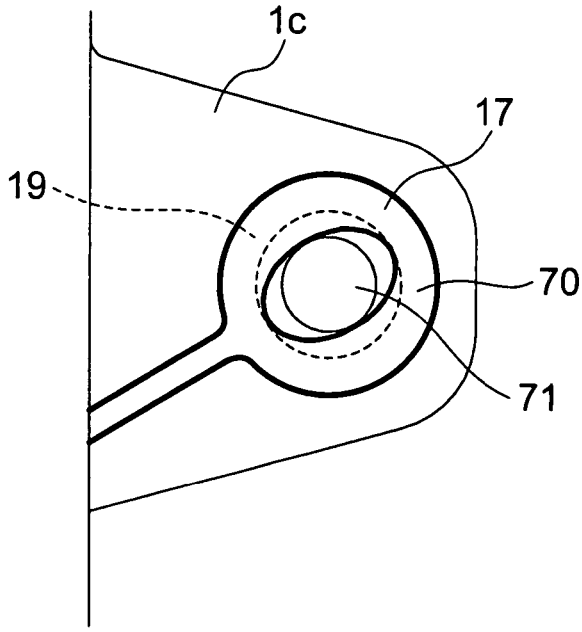
FIG. 10 is a front elevational view showing one example of a hole in a bearing surface portion according to the present invention.
Figure 11:
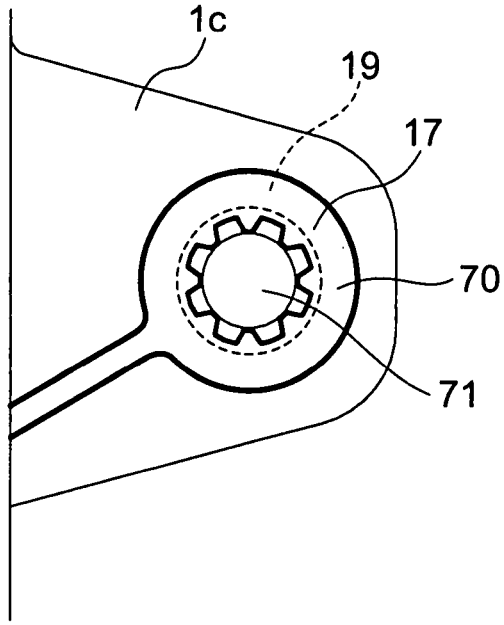
FIG. 11 is a front elevational view showing another example of a hole in a bearing surface portion according to the present invention.

In addition, as shown in FIGS. 10 and 11, a hole 71 in a bearing surface portion 70 of a GND line terminal 17 may be of an elliptic shape or a polygonal shape in which an inner peripheral edge portion of the hole 71 protrudes to an inner side of a bush 19. Also, though not illustrated, other shapes may be employed in which only a part of the peripheral wall of a hole in a bearing surface portion protrudes to an inner side of a bolt insertion hole.

While the invention has been described in terms of preferred embodiments, those skilled in the art will recognize that the invention can be practiced with modifications within the spirit and scope of the appended claims.

What is claimed is:

1. An ignition coil for an internal combustion engine in which a GND potential is ensured by a GND line terminal that is electrically connected at one end thereof to an igniter and at the other end thereof to said internal combustion engine through a bolt inserted into a bolt insertion hole formed in a mounting flange, wherein said GND line terminal is formed at its other end with a bearing surface portion having a hole into which said bolt is inserted, and at least part of an inner diameter of said hole in said bearing surface portion is smaller than an inner diameter of said bolt insertion hole, and wherein a thread being in threaded engagement with said bolt is formed on at least part of an inner peripheral wall surface of said hole in said bearing surface portion.

2. The ignition coil for an internal combustion engine as set forth in claim 1, wherein said bolt has a thread formed only at a portion thereof opposite to its head for threaded engagement with a threaded hole formed in said internal combustion engine.

3. The ignition coil for an internal combustion engine as set forth in claim 1, wherein said GND line terminal is connected to a GND terminal connected to an engine control unit.

4. The ignition coil for an internal combustion engine as set forth in claim 1, wherein a head of said bolt directly contacts at least a portion of said bearing surface portion.

* * * * *